US007806314B2

(12) United States Patent
Sutherland

(10) Patent No.: US 7,806,314 B2
(45) Date of Patent: Oct. 5, 2010

(54) CARTON WITH HANDLE AND DISPENSER

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 728 days.

(21) Appl. No.: 11/671,126

(22) Filed: Feb. 5, 2007

(65) Prior Publication Data

US 2007/0181658 A1 Aug. 9, 2007

Related U.S. Application Data

(60) Provisional application No. 60/765,994, filed on Feb. 6, 2006.

(51) Int. Cl.

| | |
|---|---|
| ***B65D 5/00*** | (2006.01) |
| ***B65D 5/46*** | (2006.01) |
| ***B65D 17/00*** | (2006.01) |
| ***B65D 65/00*** | (2006.01) |
| ***B65D 75/00*** | (2006.01) |

(52) U.S. Cl. ..... 229/243; 229/101; 229/117.12; 229/123; 229/242; 206/427

(58) Field of Classification Search ..... 229/243, 229/117.12, 123, 242, 240, 101; 62/457.1, 62/457.2, 457.4, 457.5, 457.7, 457.9; 206/427
See application file for complete search history.

(56) References Cited

U.S. PATENT DOCUMENTS

| | | | | |
|---|---|---|---|---|
| 2,594,376 | A | | 4/1952 | Arneson |
| 2,810,506 | A | | 10/1957 | Kessler |
| 2,868,433 | A | | 1/1959 | Anderson, Jr. |
| 2,955,739 | A | | 10/1960 | Collura |
| 3,112,856 | A | | 12/1963 | MacIntosh et al. |
| 3,127,720 | A | | 4/1964 | Gentry et al. |
| 3,309,005 | A | * | 3/1967 | Pilger ..... 229/241 |
| 3,886,901 | A | * | 6/1975 | Zeitter ..... 119/168 |
| 4,036,423 | A | | 7/1977 | Gordon |
| 4,111,306 | A | * | 9/1978 | Roccaforte ..... 229/240 |
| 4,216,861 | A | | 8/1980 | Oliff |
| 4,318,474 | A | * | 3/1982 | Hasegawa ..... 206/428 |

(Continued)

FOREIGN PATENT DOCUMENTS

| | | |
|---|---|---|
| CA | 2 160 145 | 9/1995 |

(Continued)

*Primary Examiner*—Gary E Elkins
*Assistant Examiner*—Latrice Byrd
(74) *Attorney, Agent, or Firm*—Womble Carlyle Sandridge & Rice, PLLC

(57) ABSTRACT

A carton for containing a plurality of articles. The carton has a plurality of panels that extend at least partially around an interior of the carton. End flaps are respectively foldably attached to panels of the plurality of panels. The end flaps are overlapped with respect to one another and thereby at least partially form a closed end of the carton. A dispenser has a tear line and at least one dispenser section foldably attached to the carton for at least partially defining an opening in the carton for accessing the containers. A gusset connects the end flaps, wherein the gusset can be unfolded to allow relative movement between the end flaps and to allow the dispenser section to pivot outwardly to enlarge the opening.

31 Claims, 4 Drawing Sheets

U.S. PATENT DOCUMENTS

| | | | | | |
|---|---|---|---|---|---|
| 4,328,923 | A | | 5/1982 | Graser | |
| 4,329,923 | A | | 5/1982 | Iida | |
| 4,364,509 | A | * | 12/1982 | Holley et al. | 221/305 |
| 4,375,258 | A | * | 3/1983 | Crayne et al. | 206/141 |
| 4,378,905 | A | | 4/1983 | Roccaforte | |
| 4,424,901 | A | * | 1/1984 | Lanier | 206/434 |
| 4,498,619 | A | | 2/1985 | Roccaforte | |
| 4,546,914 | A | | 10/1985 | Roccaforte | |
| 4,588,084 | A | | 5/1986 | Holley | |
| 4,747,487 | A | | 5/1988 | Wood | |
| 5,020,337 | A | | 6/1991 | Krieg | |
| 5,094,359 | A | | 3/1992 | DeMars et al. | |
| 5,197,598 | A | | 3/1993 | Stout et al. | |
| 5,246,112 | A | | 9/1993 | Stout et al. | |
| 5,284,294 | A | | 2/1994 | Floyd | |
| 5,292,058 | A | | 3/1994 | Zoss et al. | |
| 5,303,863 | A | | 4/1994 | Arasim | |
| 5,307,986 | A | * | 5/1994 | Schuster | 229/186 |
| 5,427,241 | A | | 6/1995 | Sutherland | |
| 5,495,727 | A | | 3/1996 | Strong et al. | |
| 5,551,556 | A | | 9/1996 | Sutherland | |
| 5,582,343 | A | | 12/1996 | Dalvey | |
| 5,639,017 | A | | 6/1997 | Fogle | |
| 5,699,957 | A | * | 12/1997 | Blin et al. | 229/117.12 |
| 5,704,470 | A | | 1/1998 | Sutherland | |
| 5,794,778 | A | | 8/1998 | Harris | |
| 5,826,782 | A | | 10/1998 | Stout | |
| 5,873,515 | A | | 2/1999 | Dunn et al. | |
| 5,915,546 | A | | 6/1999 | Harrelson | |
| 5,992,733 | A | | 11/1999 | Gomes | |
| 6,065,590 | A | | 5/2000 | Spivey | |
| 6,105,853 | A | * | 8/2000 | Lamare | 229/117.12 |
| 6,105,854 | A | | 8/2000 | Spivey et al. | |
| 6,131,803 | A | | 10/2000 | Oliff et al. | |
| 6,164,526 | A | | 12/2000 | Dalvey | |
| 6,170,741 | B1 | | 1/2001 | Skolik et al. | |
| 6,227,367 | B1 | | 5/2001 | Harrelson et al. | |
| 6,523,739 | B2 | * | 2/2003 | Heeley et al. | 229/109 |
| 6,631,803 | B2 | | 10/2003 | Rhodes et al. | |
| 6,758,337 | B2 | | 7/2004 | Chargueraud et al. | |
| 6,926,193 | B2 | | 8/2005 | Smalley | |
| 7,427,010 | B2 | * | 9/2008 | Sutherland | 229/198.2 |
| 2003/0213263 | A1 | | 11/2003 | Woog | |
| 2006/0169755 | A1 | * | 8/2006 | Spivey, Sr. | 229/117.16 |
| 2006/0273143 | A1 | | 12/2006 | Finch | |
| 2007/0051781 | A1 | | 3/2007 | Holley, Jr. | |
| 2007/0164091 | A1 | * | 7/2007 | Fogle et al. | 229/101 |

FOREIGN PATENT DOCUMENTS

| | | |
|---|---|---|
| DE | 85 14 718.4 | 6/1985 |
| WO | WO 2005/080218 A1 | 9/2005 |
| WO | WO 2007/089282 | 8/2007 |

* cited by examiner

CARTON WITH HANDLE AND DISPENSER

CROSS-REFERENCE TO RELATED APPLICATION

This application claims the benefit of U.S. Provisional Application No. 60/765,994 which was filed on Feb. 6, 2006, the entire contents of which are hereby incorporated by reference as if presented herein in their entirety.

BACKGROUND OF THE INVENTION

Cartons for accommodating beverage containers are known. A conventional carton typically has a removable dispenser panel that allows containers to be dispensed through the dispenser opening formed when the dispenser panel is removed. Alternatively, a carton may have an end panel or a side panel formed from flaps that can be separated to create a dispenser opening in the carton. Such cartons are often also provided with one or more handle apertures that allow the cartons to be carried. Such handles may, however, be cumbersome or unwieldy to use. Conventional cartons also must be refrigerated or otherwise cooled in order to maintain the carton contents at a desired temperature.

SUMMARY OF THE INVENTION

In one aspect, the invention is generally directed to a carton for containing a plurality of articles. The carton comprises a plurality of panels that extend at least partially around an interior of the carton. End flaps are respectively foldably attached to panels of the plurality of panels. The end flaps are overlapped with respect to one another and thereby at least partially form a closed end of the carton. A dispenser comprises a tear line and at least one dispenser section foldably attached to the carton for at least partially defining an opening in the carton for accessing the containers. A gusset connects the end flaps. The gusset can be unfolded to allow relative movement between the end flaps and to allow the dispenser section to pivot outwardly to enlarge the opening.

In another aspect, the invention is generally directed to a blank for forming a carton. The blank comprises a plurality of panels and end flaps respectively foldably attached to respective panels of the plurality of panels. Dispenser features comprise a tear line and at least one dispenser section for at least partially defining an opening in the carton formed from the blank. A gusset connects the end flaps and can be unfolded to allow relative movement between the end flaps and to allow the dispenser section to pivot outwardly to enlarge the opening.

In another aspect, the invention is generally directed to a method of opening a carton. The method comprises providing a carton having a plurality of panels that extend at least partially around an interior of the carton. The plurality of panels comprise a top panel, a bottom panel, a first side panel, and a second side panel, and end flaps respectively foldably attached to respective panels of the plurality of panels.

The end flaps are overlapped with respect to one another and thereby at least partially form a closed end of the carton. A handle comprises at least a portion of the top panel and the side panels. A dispenser comprising a dispenser section foldably attached to the carton and at least partially defined by a tear line in the top panel. The method further comprises grasping the handle to at least partially separate the handle from the top panel and end flaps and to create an opening for activating the dispenser, and activating the dispenser by pivoting the dispenser section outward to increase the size of a dispenser opening in the carton.

Those skilled in the art will appreciate the above stated advantages and other advantages and benefits of various additional embodiments reading the following detailed description of the embodiments with reference to the below-listed drawing figures. It is within the scope of the present invention that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., plastic beverage bottles) as disposed within the carton embodiments. In this specification, the terms "lower," "bottom," "upper" and "top" indicate orientations determined in relation to fully erected and upright cartons.

Figure 1:
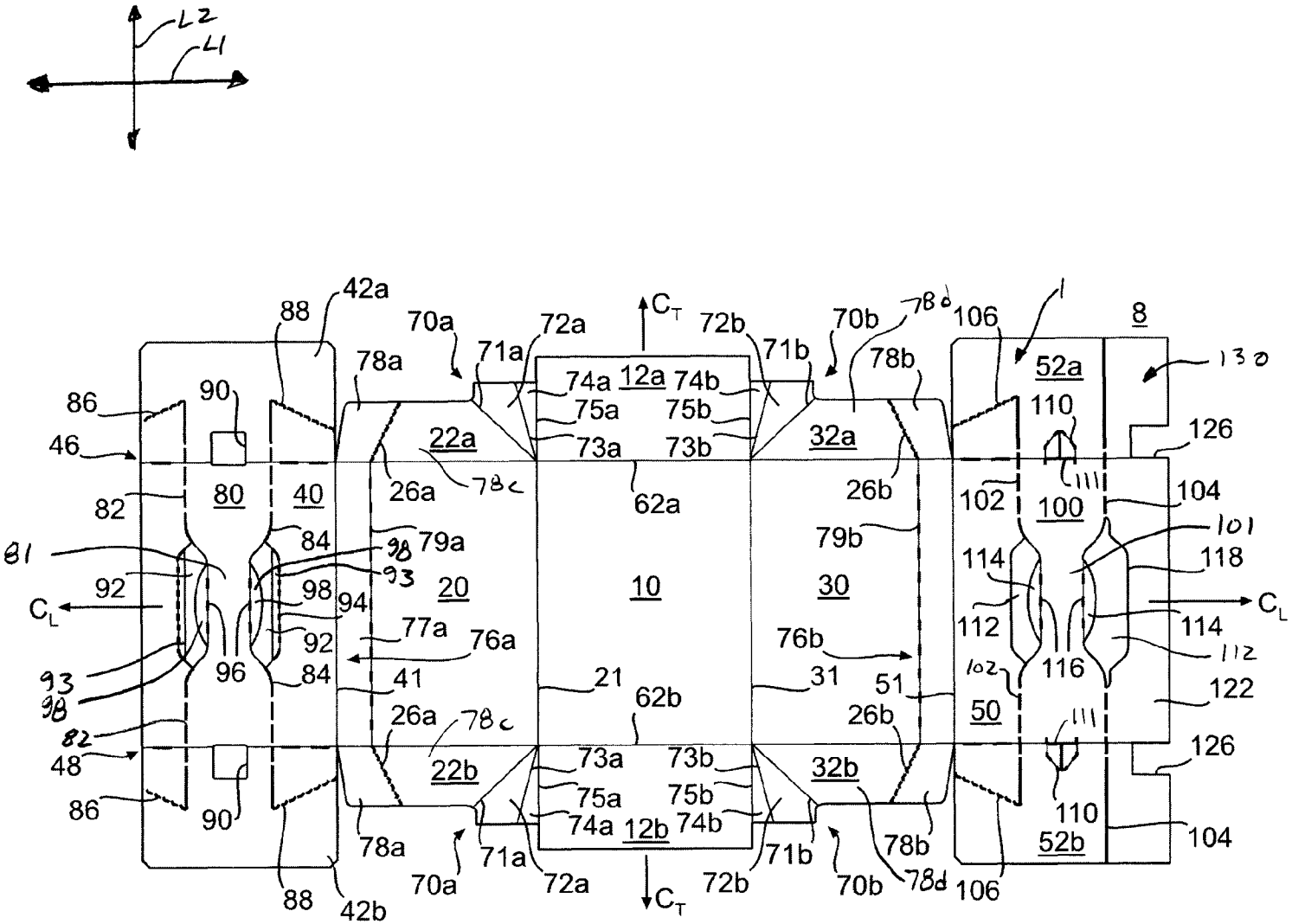
FIG. 1 is a plan view of a blank used to form a carton according to one embodiment of the invention.
Figure 2:
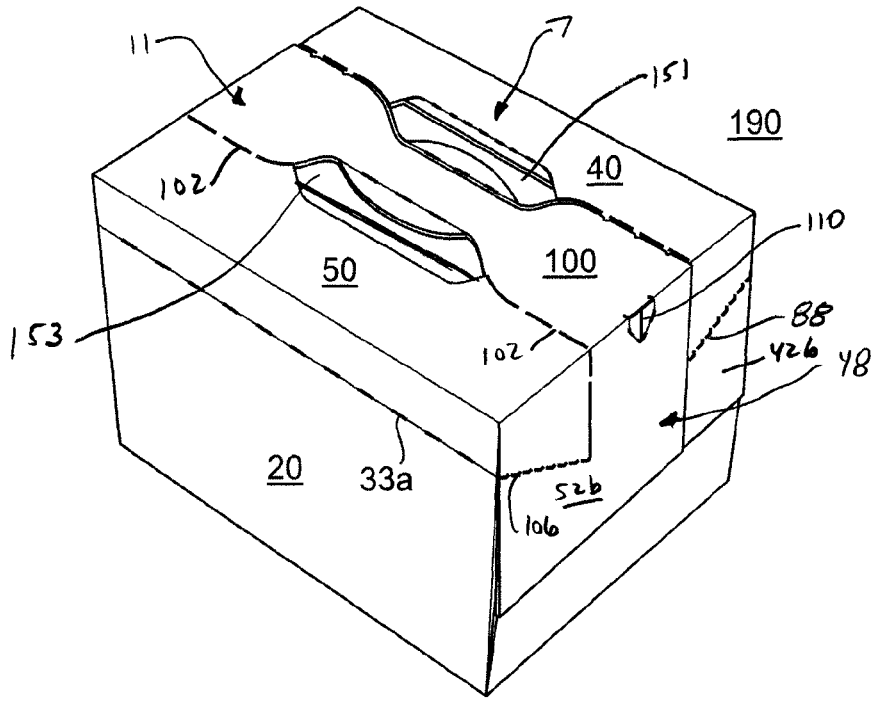
FIG. 2 is a perspective of the carton assembled from the blank.
Figure 3:
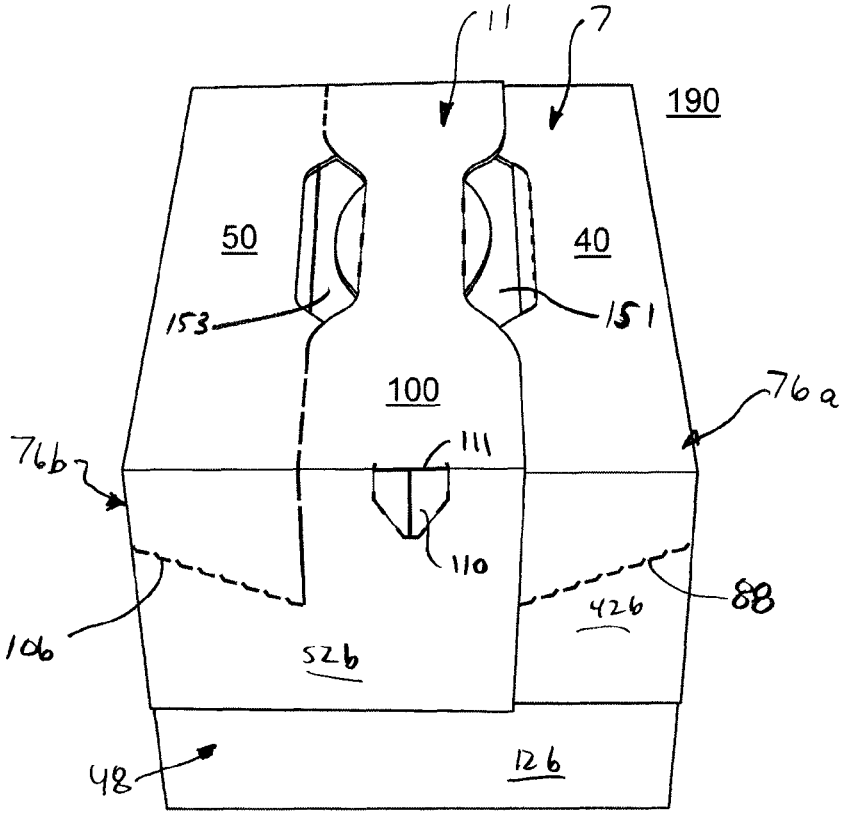
FIG. 3 is a first end view of the carton.
Figure 4:
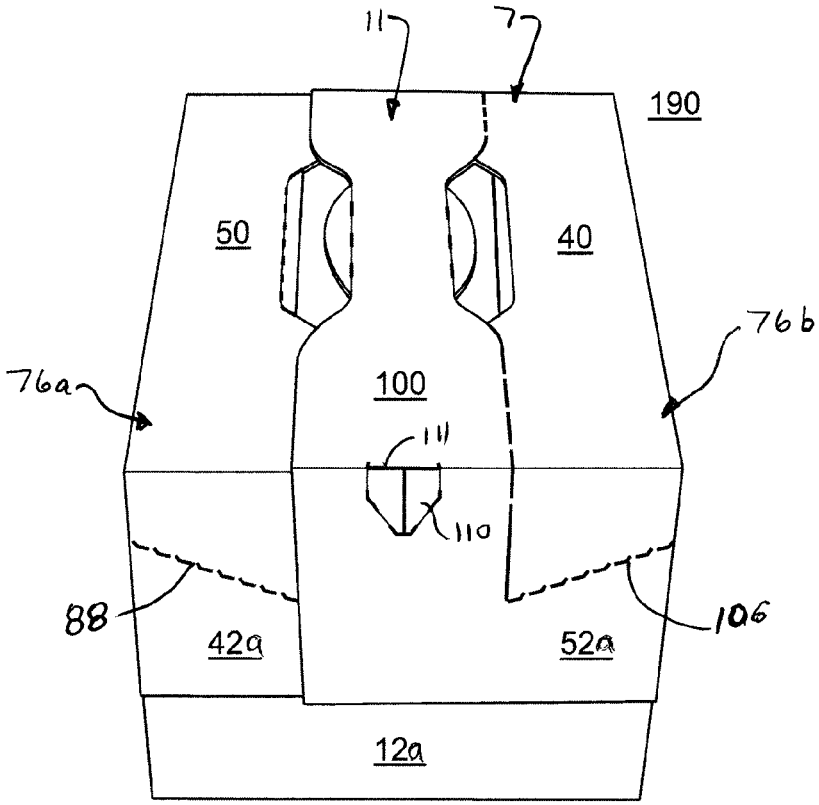
FIG. 4 is a second end view of the carton.
Figure 6:
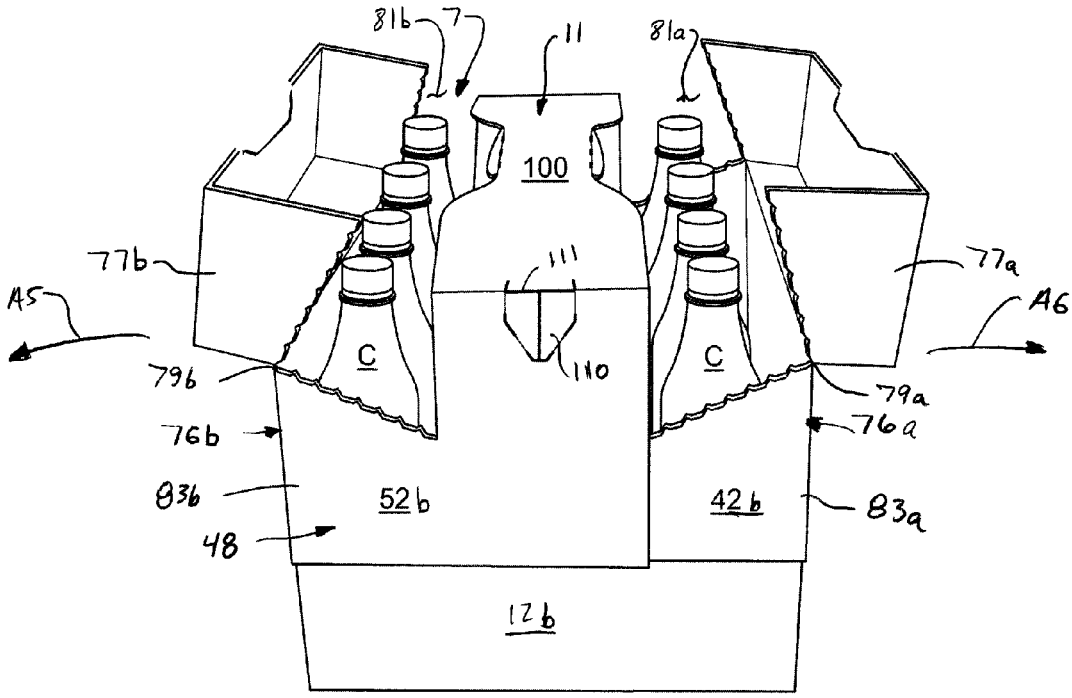
FIG. 6 is a side view of the carton with a first and a second dispenser section initially opened.
Figure 7:
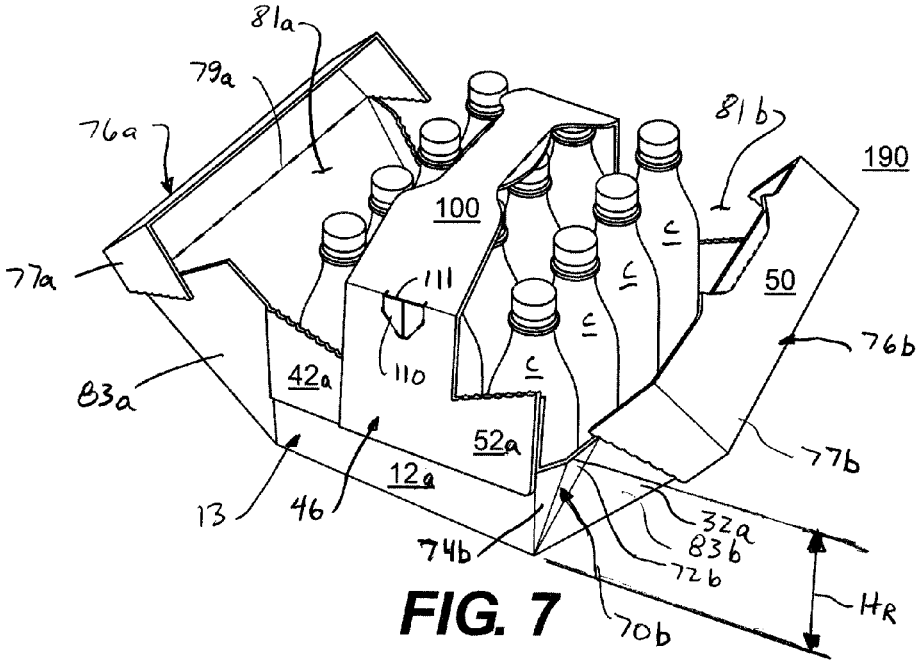
FIG. 7 is a perspective of the carton with the first and second dispenser sections further opened.

FIG. 1 is a plan view of the exterior side 1 of a blank, generally indicated at 8, used to form a carton 190 (FIG. 2) according to the exemplary embodiment of the invention. The carton 190 can be used to house a plurality of articles such as containers C (FIGS. 6 and 7). The carton 190 has a dispenser, generally indicated at 7 (FIG. 2), formed in the carton for allowing access to the containers from the top of the carton, and a handle, generally indicated at 11, formed in the top of the carton for grasping and carrying the carton. As shown in FIG. 7, a bottom receptacle 13 is formed in the bottom of the carton 190 for accommodating, for example, liquids, ice, or other coolants in the carton bottom. In one exemplary embodiment, ice can be added to the opened carton 190 to cool containers C, and beverages held therein. As the ice melts, all or a part of the resultant runoff water is held within the bottom receptacle 13.

In the illustrated embodiment, the carton 190 is sized to house twelve containers C in a single layer in a 3×4 arrangement, but it is understood that the carton may be sized and shaped to hold containers of a different or same quantity in more than one layer and/or in different row/column arrangements (e.g., 1×6, 3×6, 2×6, 2×6×2, 3×4×2, 2×9, etc.).

The blank 3 has a longitudinal axis L1 and a lateral axis L2. As shown in FIG. 1, the blank 8 may have at least partial symmetry about a longitudinal center line $C_L$ and about a lateral center line $C_T$. Therefore, certain elements in the drawing figures have similar or identical reference numerals in order to reflect the whole or partial longitudinal and transverse symmetries and similar or like elements may be indicated by an "a" or "b" suffix designation for a corresponding reference number. The blank 8 comprises a bottom panel 10 foldably connected to first and second side panels 20, 30 at transverse fold lines 21, 31, a first top panel 40 foldably connected to the first side panel 20 at a transverse fold line 41, and a second top panel 50 foldably connected to the second side panel 30 at a transverse fold line 51. The first and second top panels 40, 50 will at least partially overlap in the erected carton 190.

The bottom panel 10 is foldably connected to a first bottom end flap 12*a* and a second bottom end flap 12*b*. The first side panel 20 is foldably connected to a first side flap 22*a* and a second side flap 22*b*. The second side panel 30 is foldably connected to a first side flap 32*a* and a second side end flap 32*b*. The first top panel 40 is foldably connected to a first top end flap 42*a* and a second top end flap 42*b*. The second top panel 50 is foldably connected to a first top end flap 52*a* and a second top end flap 52*b*.

The end flaps 12*a*, 42*a*, 52*a* and side flaps 22*a*, 32*a* extend along a first marginal area of the blank 8, and are foldably connected at a first longitudinal fold line 62*a* that extends along the length of the blank. The end flaps 12*b*, 42*b*, 52*b* and side flaps 22*b*, 32*b* extend along a second marginal area of the blank 8, and are foldably connected at a second longitudinal fold line 62*b* that also extends along the length of the blank. The longitudinal fold lines 62*a*, 62*b* may be, for example, substantially straight, or offset at one or more locations to account for blank thickness or for other factors. When the carton 5 is erected, the end flaps 12*a*, 42*a*, 52*a* and side flaps 22*a*, 32*a* close a first end 46 of the carton, and the end flaps 12*b*, 42*b*, 52*b* and side flaps 22*b*, 32*b* close a second end 48 of the carton. In accordance with an alternative embodiment of the present invention, different flap arrangements can be used for closing the ends 46, 48 of the carton 5.

Four gussets 70*a*, 70*b* are formed in the blank 8, one at each corner of the bottom panel 10. Two of the gussets 70*a* are respectively foldably connected to a side flap 22*a*, 22*b* of the first side panel 20 at an oblique fold line 71*a*, and to a bottom end panel 12*a*, 12*b* at a lateral fold line 75*a*. Each gusset 70*a* comprises a first gusset panel 72*a* foldably connected to a second gusset panel 74*a* at an oblique fold line 73*a*. The other two gussets 70*b* are respectively foldably connected to a side flap 32*a*, 32*b* of the second side panel 30 in a similar arrangement and manner as the gussets 70*a*.

The features that comprise the handle 11 include a first handle panel 80 in the first top panel 40 and end flaps 42*a*, 42*b* defined by lateral tear lines 82, 84 and oblique end tear lines 86, 88. The handle panel includes a narrow gripping portion 81 centrally located in the top panel 40. The first top panel 40 includes apertures 92 adjacent the gripping portion 81 and at least partially defining access flaps 93 foldably connected to the top panel 40 by lateral fold lines 94, and cushion portions 98 foldably connected to the handle portion at lateral fold lines 96. End handle apertures 90 are formed at opposite ends of the handle portion 80 at the fold lines 62*a*, 62*b*.

In the illustrated embodiment, the features that form the handle 11 include a second handle panel 100 in the second top panel 50. The second handle panel 100 is defined by a lateral tear line 102 in the top panel 50 and side end flaps 52*a*, 52*b*, and a lateral fold line 104 longitudinally spaced from the tear line 102 in the top panel and extending across the end flaps 52*a*, 52*b*. The tear line 102 includes oblique end tear lines 106 in the end flaps 52*a*, 52*b*. The second handle panel 100 includes a gripping portion 101 centrally located in the top panel 50. The second handle panel 100 includes a flap 110 at least partially defined by a tear line in respective end flaps 52*a*, 52*b* and foldably attached at longitudinal fold lines 111 that generally coincide with the longitudinal fold lines 62*a*, 62*b*. Cushion portions 114 are foldably connected to the handle section 100 at fold lines 116. Handle apertures 112 are formed on respective sides of the handle section 100. A handle reinforcement flap 130 is foldably attached to the second handle portion 100 at the longitudinal fold line 104 and comprises a portion of respective end flaps 52*a*, 52*b* and the top panel 50. The handle reinforcement flap 130 includes notches 126 adjacent longitudinal fold lines 62*a*, 62*b*. In the illustrated embodiment the reinforcement flap 130 extends across the lateral width of the blank 8, but the reinforcement flap may be otherwise shaped and configured without departing from the invention.

In the illustrated embodiment, the features that comprise the dispenser 7 include a first dispenser section 76*a* on one side of the handle 11 and a second dispenser section 76*b* on the other side of the handle. The first dispenser section 76*a* is at least partially defined by the tear line 84 in the top panel, the tear lines 88 in the end panels 42*a*, 42*b*, and oblique tear lines 26*a* in the side flaps 22*a*, 22*b*. The first dispenser section 76*a* includes an upper (first) portion 77*a* that is pivotally attached to the side panel 20 at a first pivot location in the form of longitudinal fold line 79*a*. The upper portion 77*a* of the first dispenser section 76*a* includes a portion of the side panel 20, a portion of the top panel 40 and portions of the end panels 22*a*, 22*b*. The first dispenser section 76*a* includes a lower (second) portion 83*a* that is pivotally attached to the bottom panel 10 at a second pivot location in the form of longitudinal fold line 21. The lower portion 83*a* of the first dispenser section 76*a* includes the portion of the side panel 20 below fold line 79*a*, portions of the side flaps 22*a*, 22*b* below tear lines 26*a*, and the gussets 70*a* connecting the side flaps 22*a*, 22*b* to the end flaps 12*a*, 12*b*.

The second dispenser section 76*b* is generally shaped and constructed to have similar elements as the first dispenser section 76*a*. The second dispenser section 76*b* has an upper portion 77*b* pivotally attached to second side panel 30 at later fold line 79*b* and a lower portion 83*b* pivotally attached to the bottom panel 10 shaped and constructed as the first dispenser section 76*a*. It is understood that the second dispenser section could be omitted or that the second dispenser section could be otherwise shaped and arranged without departing from the invention.

An exemplary method of erecting the carton 190 is discussed in detail below. Glue or other adhesive is applied to the upper or exterior side of the first top panel 40, in regions generally between fold line 94, tear line 84 and fold line 41. Glue may also be applied to the lower or interior side of the second top panel 50, in regions generally between tear lines 102 and fold line 51, and to at least a portion of the reinforcement flap 130. All or a portion of the interior of the end panels

42*a*, 42*b*, 52*a*, 52*b* may also have glue applied thereto. Portions of the end panels 22*a*, 22*b* that will overlap one or more of the gusset panels 72, 74 may also have glue applied thereto. Containers C may be wrapped within the blank 8 in a 3×4×1 arrangement. The reinforcing flap 130 is folded inwardly about fold line 104 so that the underside of the reinforcing flap 130 overlaps the underside of the second handle portion 100. The first and second top panels 40, 50 are overlapped to secure them together. The ends of the blank 8 may be closed by folding the gusset panels 72, 74 inwardly, along with folding the end panels 12, 22, 42, 52 inwardly.

In the illustrated embodiment, the handle 11 is a three-ply handle formed by the first and second handle panels 80, 100 and the reinforcing portion 130, but the handle may comprise more or less than three layers of material without departing from the invention. The handle 11 includes handle openings 151, 153 on either side of the overlapped handle panels 80, 100. The carton 190 may be, for example, parallelepipedal or generally parallelepipedal in shape, or may be other shapes without departing from the invention.

Figure 5:
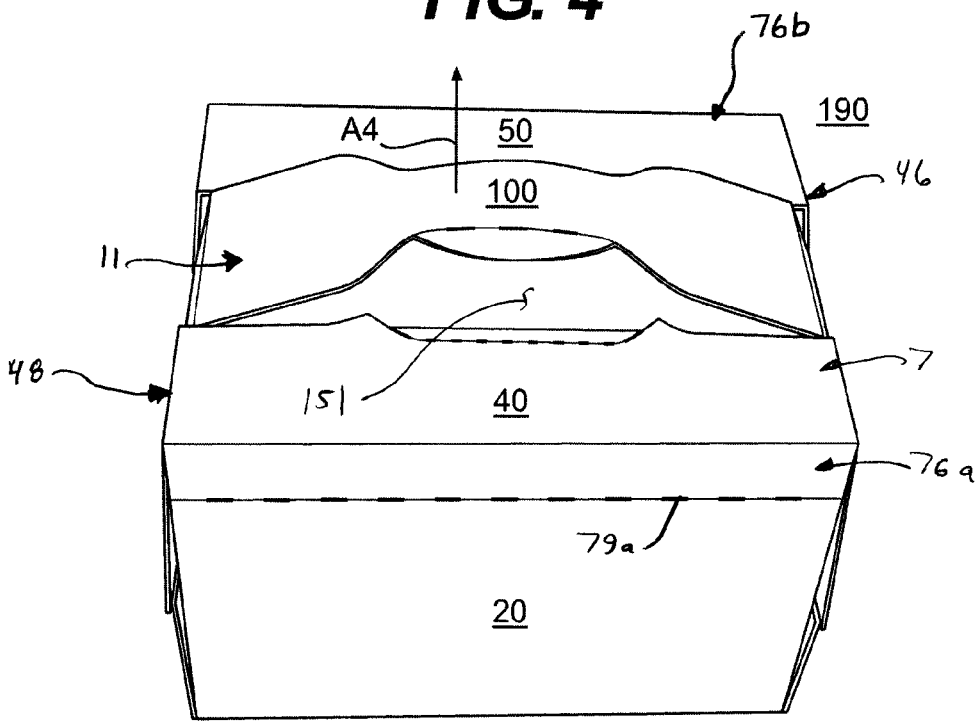
FIG. 5 is a side view of the carton showing a handle initially activated to a position for carrying the carton.

The handle 11 may be activated by a user placing there fingers in the handle openings 151, 153 and grasping the overlapped handle panels 80, 100 to lift the handle portions upward away from the top panels 40, 50 generally in the direction of arrow A4 in FIG. 5. The lifting of the handle panels 80, 100 tears the handle 11 at tear lines 82, 84, and 102 so as to at least partially separate the handle from the overlapped top panels 40, 50 and the overlapped end flaps 42*a*, 42*b*, 52*a*, 52*b*. The handle 11 may be further partially extended so that the handle further separates from a remainder of the carton 190 along one or more of the lines 82, 84, 102, 104 (FIG. 1). The carton 190 may be carried by the extended handle 11. Alternatively, the carton may be grasped and carried by respective openings (not shown) formed by folding the carton flaps 110 inward about fold lines 111.

As shown in FIG. 6, the dispenser 7 is activated to a partially opened condition by breaching the carton along the lines 86, 88, 106, 26 (FIG. 1) and pivoting the upper portions 77*a*, 77*b* of the first and second dispenser sections 76*a*, 76*b* about the fold lines 79*a*, 79*b* so as to create respective dispenser openings 81*a*, 81*b*. The dispenser openings 81*a*, 81*b* allow access to the carton 190 and expose the tops of the containers C. As shown in FIG. 10, the dispenser openings 81*a*, 81*b* of the carton 190 are further opened by pivoting the lower portions 83*a*, 83*b* of the dispenser sections 76*a*, 76*b* by pulling the side panels 20, 30 outwardly in the direction of arrows A5, A6, to extend the gussets 70*a*, 70*b* outwardly. In the illustrated embodiment, glue may be selectively applied to either the top panels 42*a*, 42*b* or the side panels 22*a*, 22*b*, 32*a*, 32*b* so that only an upper portion 78*a*, 78*b* of the side panels is adhered to the top panels. Lower portion 78*c*, 78*d* of the side panels 22*a*, 22*b*, 32*a*, 32*b* below the tear lines 26*a*, 26*b* are free from adhesive attachment to the top panels 42*a*, 42*b* and the gussets 70*a*, 70*b* so that the lower portions can pivot outwardly when the dispenser sections are pivoted and the gussets unfolded. Alternatively, one or more of the gusset panels 72, 74 may be glued to an opposed side end panel 22, 32 to maintain the side walls 20 at a desired angle with respect to the bottom panel 10. The pivoting of the lower portions 83*a*, 83*b* of the dispenser sections 76*a*, 76*b* expands the dispenser openings 81*a*, 81*b*.

According to the above embodiment, ice, cold water, additional containers, or other items, for example, can be placed in the carton 190 through one or both of the dispenser openings 81*a*, 81*b*. The gussets 70, the bottom end panels 12, and the side end panels 22 at least partially close the bottom portion of the carton 190 and create the partially closed bottom receptacle 13 in the bottom of the carton. The partially closed bottom receptacle 13 of the opened carton 190 can therefore be used to retain liquids, such as water formed from melting ice, condensation, other liquids, and articles such as, for example, refuse or fine particulate matter such as powders.

Referring to FIG. 7, the bottom receptacle 13 may have a height $H_R$ below which the carton 190 is liquid-tight. The height $H_R$ represents a portion of the bottom of the carton 190 below which no glued seals or seams are formed through which water or other liquid might leak. That is, in accordance with the illustrated embodiment, no adhesive seal or other joinder of material where fluid might escape the carton 190 is located in the carton below the height $H_R$. The bottom receptacle 13 may therefore be formed from a continuous section of folded material of the blank 8. The height $H_R$ of the liquid-tight portion of the receptacle 13 below which there are no glued seams may generally be between approximately 0 inches to approximately 4 inches (approximately 0 mm to approximately 102 mm), and, more preferably, may be approximately 2¾ inches (approximately 70 mm). It is understood that all dimensional information presented herein is intended to be illustrative and is not intended to be used to limit the scope of the invention.

The handle 11 of the illustrated embodiment is a three-ply handle comprising three layers of material (e.g., handle portions 80, 100 and reinforcement flap 130). The handle 11 allows the carton 190 to be carried using only one hand. The handle 11 can be selected, for example, to have sufficient strength to carry the carton 190, containers C accommodated in the carton, and additional items such as ice or cold water loaded into the carton 190 after the carton has been opened.

Cartons according to the principles of the present invention may be formed from materials such as paperboard. Therefore, if exposed to water or other liquids for extended periods of time, the carton may allow for the passage of liquid through the wetted carton surfaces due to partial permeability of the carton material. In this specification, the term "liquid-tight" is generally used to define a section of a carton that is formed from a continuous section of material or of a section without any glued seams through which liquid or fine particulate matter might leak, and the term "liquid-tight" therefore encompasses cartons that may become partially water permeable over time.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. For example, the caliper can be at least about 16. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

In accordance with the exemplary embodiment of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or panels adhered together by glue. The term "glue" is intended to encompass all manner of adhesives commonly used to secure carton panels in place.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carton for containing a plurality of articles, the carton comprising:

a plurality of panels that extend at least partially around an interior of the carton, wherein the plurality of panels comprises at least one top panel, a bottom panel, a first side panel, and a second side panel;

end flaps respectively foldably attached to panels of the plurality of panels, wherein the end flaps are overlapped with respect to one another and thereby at least partially form a closed end of the carton, a dispenser comprising a tear line and at least one dispenser section foldably attached to the carton for at least partially defining an opening in the carton for accessing the containers, wherein the dispenser section comprises a first portion pivotally attached to a lower portion of the first side panel at a first pivot location to allow an initial opening of the dispenser, the first portion comprising an upper portion of the first side panel, and the first pivot location comprising a fold line extending in the first side panel, the fold line being spaced apart from the at least one top panel and the bottom panel; and a gusset connecting the end flaps, wherein the gusset can be unfolded to allow relative movement between the end flaps and to allow the dispenser section to pivot outwardly to enlarge the opening.

2. The carton of claim 1 wherein the first portion further comprises a portion of the top panel and portions of the end panels.

3. The carton of claim 2 wherein the dispenser section comprises a second portion pivotally attached to the bottom panel at a second pivot location to allow the dispenser section to pivot outward relative to the bottom panel so as to expand the opening, and wherein the second portion is pivotally attached to the first portion at the fold line.

4. The carton of claim 3 wherein the second portion comprises the lower portion of the first side panel, a portion of the end panels and the gusset.

5. The carton of claim 4 wherein the dispenser section is a first dispenser section, the opening is a first opening, and the carton further comprises a second dispenser section for creating a second opening in the carton to access the containers.

6. The carton of claim 5 wherein the carton further comprises a handle in the top panel and the first and the second openings are respectively adjacent the handle.

7. The carton of claim 5 wherein the second dispenser section has a first portion pivotally attached to a lower portion of the second side panel at a first pivot location and a second portion pivotally attached to the bottom panel at a second pivot location.

8. The carton of claim 7 wherein the first pivot location of the second dispenser section comprises a fold line in the second side panel and is for initially opening the second dispenser section, wherein the fold line is spaced apart from the at least one top panel and the bottom panel.

9. The carton of claim 8 wherein the second pivot location of the second dispenser section comprises a fold line foldably connecting one of the side panels and the bottom panel and is for pivoting the second dispenser section outward relative to the bottom panel so as to expand the opening.

10. The carton of claim 5 wherein the gusset includes two gussets at least partially defining the first dispenser section and two gussets at least partially defining the second dispenser section, wherein the first dispenser section, second dispenser section, the bottom panel, and end panels cooperate to form a bottom receptacle of the carton.

11. The carton of claim 10 wherein the bottom receptacle is free of glued seams.

12. The carton of claim 1 wherein the end flaps comprise side end flaps, bottom end flaps, and top end flaps, and the gusset comprises gussets respectively connecting adjacent bottom and side end flaps.

13. The carton of claim 12 wherein an upper portion of the side end flaps is respectively adhesively attached to the top end flaps and a lower portion of the side end flaps is free to pivot with one of the side panels.

14. The carton of claim 1 further comprising a handle comprising at least a portion of the top panel and at least a portion of the end flaps.

15. The carton of claim 14 wherein the tear line defining the dispenser section is adjacent to and at least partially defines the handle.

16. The carton of claim 14 wherein the end flaps comprise top end flaps and the handle comprises a handle panel comprising at least a portion of the top panel and the top panel end flaps, and a gripping portion formed in the top panel.

17. The carton of claim 16 wherein the handle panel is at least partially defined by two spaced apart tear lines in the top panel and the top panel end flaps.

18. A carton for containing a plurality of articles, the carton comprising:

a plurality of panels that extend at least partially around an interior of the carton;

end flaps respectively foldably attached to panels of the plurality of panels, wherein the end flaps are overlapped with respect to one another and thereby at least partially form a closed end of the carton, a dispenser comprising a tear line and at least one dispenser section foldably attached to the carton for at least partially defining an opening in the carton for accessing the containers;

a gusset connecting the end flaps, wherein the gusset can be unfolded to allow relative movement between the end flaps and to allow the dispenser section to pivot outwardly to enlarge the opening; and a handle comprising at least a portion of the top panel and at least a portion of the end flaps; wherein:

the plurality of panels comprises at least one top panel, a bottom panel, a first side panel, and a second side panel;

the end flaps comprise top end flaps and the handle comprises a handle panel comprising at least a portion of the top panel and the top panel end flaps, and a gripping portion formed in the top panel;

the handle panel is at least partially defined by two spaced apart tear lines in the top panel and the top panel end flaps; and the top panel is a first top panel, the top panel end flaps are first top end flaps foldably attached to the first top panel, and the handle panel is a first handle panel, the carton comprises a second top panel for overlapping engagement with the first top panel, and second top end flaps foldably attached to the second top panel, and the handle comprises a second handle panel in the second top panel and the second top end flaps.

19. The carton of claim 18 further comprising a reinforcement panel foldably attached to the second handle panel, the reinforcement panel comprising at least a portion of the second top panel and the second top panel end flaps.

20. The carton of claim 19 wherein the handle is a three-ply handle comprising the first handle panel, the second handle panel, and the reinforcement panel.

21. A blank for forming a carton comprising:

a plurality of panels comprising at least one top panel, a bottom panel, a first side panel, and a second side panel;

end flaps respectively foldably attached to respective panels of the plurality of panels; wherein the end flaps are adapted to overlap with respect to one another and thereby at least partially form a closed end of the carton formed from the blank;

dispenser features comprising a tear line and at least one dispenser section for at least partially defining an opening the carton formed from the blank, wherein the dispenser section comprises a first portion pivotally attached to a lower portion of the first side panel at a first pivot location to allow an initial opening of the dispenser in the carton formed from the blank, the first portion comprising an upper portion of the first side panel, and the first pivot location comprising a fold line extending in the first side panel, the fold line being spaced apart from the at least one top panel and the bottom panel;

a gusset connecting the end flaps, wherein the gusset can be unfolded to allow relative movement between the end flaps and to allow the dispenser section to pivot outwardly to enlarge the opening.

22. The blank of claim 21 wherein the first portion further comprises a portion of the top panel and portions of the end flaps.

23. The blank of claim 21 wherein the dispenser section comprises a second portion pivotally attached to the bottom panel at a second pivot location, the second portion comprises the lower portion of the first side panel, and two gussets.

24. The blank of claim 23 wherein the dispenser section is a first dispenser section, and the dispenser features further comprise a second dispenser section.

25. The blank of claim 24 wherein the second dispenser section has a first portion pivotally attached to a lower portion of the second side panel at a first pivot location and a second portion pivotally attached to the bottom panel at a second pivot location, the first pivot location comprises a fold line in one of the side panels and spaced apart from the at least one top panel and the bottom panel, and the second pivot location comprises a fold line foldably connecting the second side panel and the bottom panel.

26. The blank of claim 21 further comprising handle features in at least a portion of the top panel and at least a portion of the end flaps for forming a handle in the carton formed from the blank.

27. The blank of claim 26 wherein the dispenser features include a tear line defining the dispenser section that is adjacent to and at least partially defines at least one handle feature.

28. The blank of claim 26 wherein the end flaps comprise top end flaps foldably attached to the top panel, and the handle features comprise a handle panel comprising at least a portion of the top panel and the top end flaps, with the handle panel comprising a gripping portion formed in the top panel.

29. The blank of claim 28 wherein the handle panel is at least partially defined by two spaced apart tear lines in the at least one top panel and the end flaps.

30. A blank for forming a carton comprising:

a plurality of panels;

end flaps respectively foldably attached to respective panels of the plurality of panels;

dispenser features comprising a tear line and at least one dispenser section for at least partially defining an opening the carton formed from the blank;

a gusset connecting the end flaps, wherein the gusset can be unfolded to allow relative movement between the end flaps and to allow the dispenser section to pivot outwardly to enlarge the opening; and handle features in at least a portion of the top panel and at least a portion of the end flaps for forming a handle in the carton formed from the blank; wherein:

the plurality of panels comprises at least one top panel, a bottom panel, a first side panel, and a second side panel;

the end flaps comprise top end flaps foldably attached to the top panel, and the handle features comprise a handle panel comprising at least a portion of the top panel and the top end flaps, with the handle panel comprising a gripping portion formed in the top panel; and the top panel is a first top panel, the top end flaps are first top end flaps foldably attached to the first top panel, and the handle panel is a first handle panel, the blank comprises a second top panel and second top end flaps foldably attached to the second top panel, and the handle features comprises a second handle panel in the second top panel and the second top end flaps.

31. The blank of claim 30 further comprising a reinforcement panel foldably attached to the second handle portion, the reinforcement panel comprising at least a portion of the second top panel and second top end flaps.

* * * * *